United States Patent [19]

Chiarella

[11] Patent Number: 4,470,175

[45] Date of Patent: Sep. 11, 1984

[54] FASTENING DEVICE FOR SKI-BOOTS

[75] Inventor: Phil Chiarella, Westmount, Canada

[73] Assignee: Warrington Inc., Missisagua, Canada

[21] Appl. No.: 385,056

[22] Filed: Jun. 4, 1982

[30] Foreign Application Priority Data

Jun. 16, 1981 [IT] Italy ..... 22342 A/81
Jan. 12, 1982 [IT] Italy ..... 19061 A/82

[51] Int. Cl.[3] ..... A43B 5/04

[52] U.S. Cl. ..... 24/70 SK; 24/71 SK; 36/50

[58] Field of Search ..... 24/68 SK, 69 SK, 70 SK, 24/71 SK, 273, 275, 276, 277; 36/50, 117

[56] References Cited

U.S. PATENT DOCUMENTS

| | | | |
|---|---|---|---|
| 842,609 | 1/1907 | Apgai | 24/275 |
| 3,601,865 | 8/1971 | Schoch | 24/69 SK |
| 3,643,295 | 2/1972 | Schoch | 24/70 SK |
| 4,096,648 | 6/1978 | Gaolo | 36/50 |

FOREIGN PATENT DOCUMENTS

| | | | |
|---|---|---|---|
| 1911666 | 9/1970 | Fed. Rep. of Germany | 24/70 SK |
| 1685822 | 8/1971 | Fed. Rep. of Germany | 36/50 |
| 2157948 | 5/1972 | Fed. Rep. of Germany | 36/50 |
| 2335679 | 3/1975 | Fed. Rep. of Germany | 24/69 SK |
| 694728 | 9/1965 | Italy | 24/70 SK |
| 47024 | 3/1982 | Italy | 24/71 SK |

*Primary Examiner*—Gene Mancene
*Assistant Examiner*—John G. Weiss
*Attorney, Agent, or Firm*—Birch, Stewart, Kolasch & Birch

[57] ABSTRACT

A fastening device for ski-boots includes a lever which is mounted on a support base fixed to the boot, and a ring which is connected to a tightening unit through a tie rod and is engageable with one of a plurality of hook-shaped seats formed in the lever. The tie rod is adjustable in length so that the tightness of the fastening can be adjusted even when the device is in its working condition, that is, under load.

3 Claims, 6 Drawing Figures

FASTENING DEVICE FOR SKI-BOOTS

BACKGROUND OF THE INVENTION

1. Field of the Invention

The present invention relates to a fastening device of ski-boots.

2. Description of Background Art

It is known that one of the more widely used devices for fastening ski-boots comprises a plate provided with a plurality of identical, parallel, hooked-shaped seats and a metal ring with a substantially rectangular profile, one side of which is releasably engageable with one of the hook-shaped seats while the opposite side is pivoted to the end of a tightening unit. This tightening unit, in its turn, comprises a second-class lever pivoted on a plate-like base, and a rod-shaped tie having one end pivoted at the point of action of the lever and the other end connected to the aforementioned metal ring. Usually, the tie rod has a threaded end portion which is engaged with a nut fixed to the metal ring. By means of this screw and nut coupling, it is possible to adjust the tightness of the fastening.

Although advantageous from several aspects, due to the manner in which the tightness of the fastening is adjusted, this fastening device has a technical disadvantage which has not been overcome until now. In fact, for this adjustment, it is always necessary to disengage the ring from the respective hook-shaped seat and rotate it to operate the screw and nut coupling, and then re-engage the ring in the hook-shaped seat to check the degree of tightness of the fastening which has been achieved. The desired tightness is usually achieved after a number of these operations, which, when effected under unfavourable conditions, may be laborious and tiring to the extent that the user frequently does not complete the desired adjustment.

SUMMARY AND OBJECTS OF THE INVENTION

To overcome this technical disadvantage, the main object of the present invention is to provide a ski-boot fastening device with structural and functional characterstics which allow the tightness of the fastening to be adjusted under load, that is, to allow the tightness of the fastening to be adjusted when the fastening is operative.

This object, and others which will become more apparent from the following description, are achieved by a fastening device for ski-boots, comprising a plate-like lever pivoted on a support base, a plurality of identical, parallel, essentially hook-shaped seats which are formed transversely on the plate-like lever on its side facing the support base, a hook member for releasably engaging one of the hook-shaped seats of the plate-like lever, a tie having one end pivoted to a tightening unit and its other end connected to the hook member through a screw and nut-type coupling, characterised in that at least one member of the screw and nut coupling is freely rotatable relative to the hook member when engaged in one of the hook-shaped seats of the plate-like lever.

BRIEF DESCRIPTION OF THE DRAWINGS

Further characteristics and advantages of the fastening device of this invention will become clearer from the description of some preferred embodiments given below, by which of example, with reference to the appended drawings, in which.

DETAILED DESCRIPTION OF THE INVENTION

Figure 1:
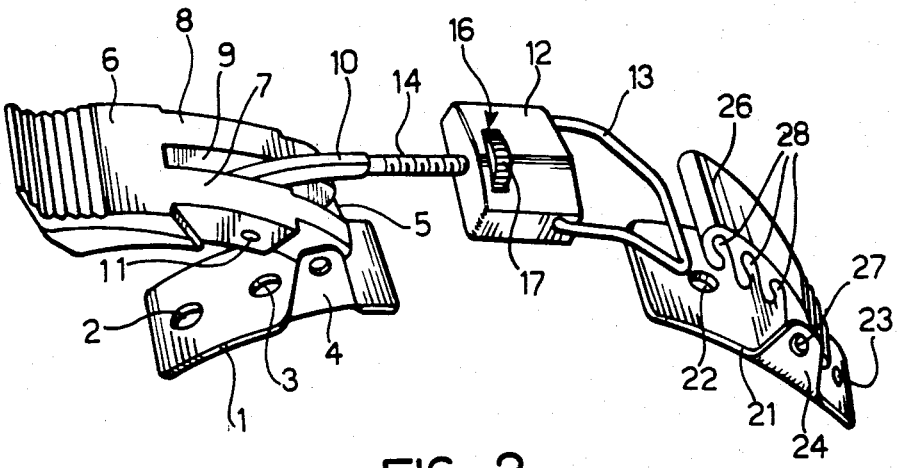
FIGS. 1 and 2 are schematic perspective views of a first embodiment of a fastening device according to the invention in two different conditions of operation.
Figure 2:
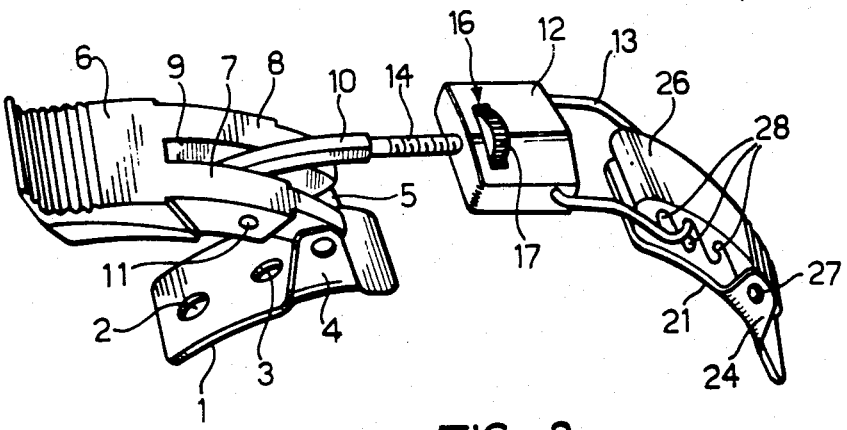
Figure 3:
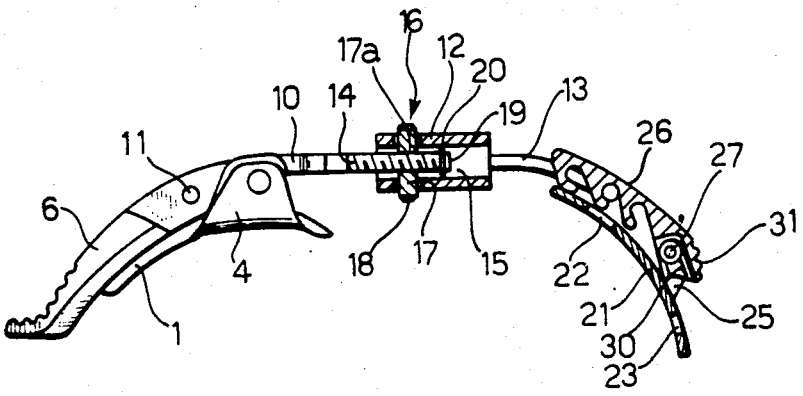
FIG. 3 shows the fastening device of FIGS. 1 and 2 in longitudinal section.

With reference to FIGS. 1, 2 and 3, a ski-boot fastening device according to the present invention includes a metal plate-like base 1 provide with holes 2, 3 for engagement by means, such as rivets (not shown), for fixing it to the upper of a ski-boot, and provided on opposite sides with a pair of parallel, essentially triangular lugs 4, 5. A second-class lever 6 is pivotally mounted on these lugs 4, 5. The lever 6 is of the forked type with parallel, spaced-apart arms 7, 8 between which is formed a longitudinal slot 9. The arms 7, 8 support a pin 11 which extends transverse with respect to the slot 9 and on which is rotatably mounted a tie rod 10. The tie rod 10 is subjected to the action of resilient means (not shown) which keep it aligned with the arms 8, 9.

A metal ring 13 is pivoted to one end of a metal plate-like element 12. This plate-like element 12 has a slot 16 in which is located a wheel 17 having a diameter greater than the thickness of the element 12 so that the wheel can be manipulated from outside the element 12. The wheel 17 has a threaded axial through-hole 17*a* into which is screwed a threaded end portion 14 of the tie rod 10. It should be noted that, in order to achieve the screw engagement, a suitable through-hole 15 with a diameter greater than the external diameter of the threaded portion 14 is formed in the plate-like element 12. It should also be noted that a retaining ring 20 is fitted onto the end 19 of the threaded portion 14 within the hole 15 for bearing against the wheel 17, to prevent the complete unscrewing of the threaded portion 14.

A metal plate-like support base 21 is provided with holes 22, 23 for engagement by means, such as rivets (not shown), for fixing it to the upper of the ski boot. The support base 21 is provided on opposite sides with lugs 24, 25 which are parallel and essentially triangular. A plate-like lever 26 has one end pivoted on a pin 27 carried by the lugs 24, 25. The side of the plate-like lever 26 facing the support base 21 is formed transversely with a plurality of identical, parallel, hook-shaped seats 28 (in the example illustrated the lever 26 has three hook-shaped seats). The structure and size of these hook-shaped seats 28 are such that they can be engaged by the ring 13.

It should be noted that a spring 30 biases the lever 26 towards the support base 21. Moreover, the lever has a knurled end portion 31 for working it.

When fastening has been effected by the engagement of the ring 13 with one of the hook-shaped seats 28 and the fastening has subsequently been tightened by lowering the lever 6 into the position illustrated in FIG. 3, the fastening tightness may be further adjusted "under load". Indeed, it suffices to rotate the wheel 17, resulting in "fine" displacement of the plate-like element 12 and, hence, of the ring 13, along the threaded portion 14 of the tie rod 10.

Tl..s adjustment under load, that is to say, when the engagement between the ring 13 and one of the hook-shaped seats 28 is operative, allow the disadvantages of the similar devices of the prior art to be decisively overcome.

Figure 4:
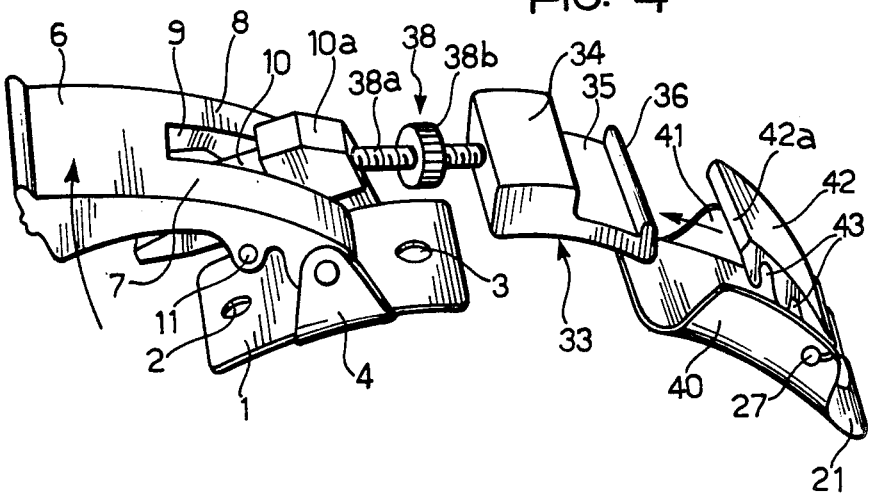
FIGS. 4 and 5 shows a second embodiment of a fastening device according to the invention in perspective and in two different conditions of use.
Figure 5:
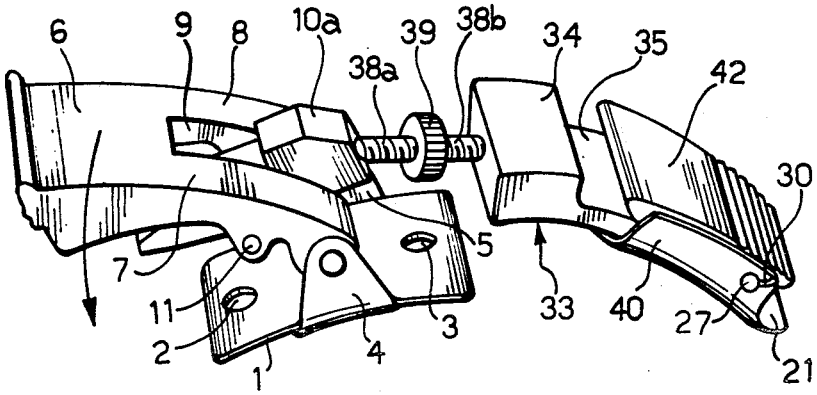
Figure 6:
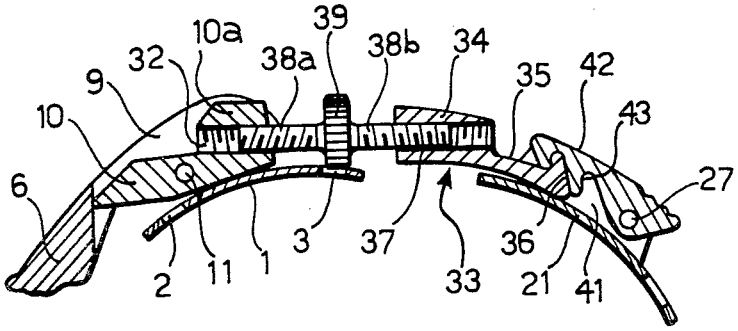
FIG. 6 is a longitudinal section of the device of FIGS. 4 and 5.

FIGS. 4, 5 and 6 illustrate a second embodiment of a fastening device according to the invention. In these Figures, components similar to those described in relation to the device of FIGS. 1 to 3 have been indicated by the same reference numerals.

According to this embodiment, the tie rod 10 has an enlarged end forming a head 10*a* with a longitudinal threaded through-hole 32, while the hook member previously constituted by the ring 13 is now formed by a plate-like body 33 which has an essentially parallelepiped-shaped end portion 34 and a portion 35 of smaller thickness than the preceding part, having a hook-shaped free end 36. The parallelepiped-shaped portion 34 has a threaded through-hole 37.

A shaft, generally indicated 38, is constituted by two threaded portions 38*a*, 38*b* which are oppositely threaded. The portion 38*a* is screwed into the threaded hole 32 in the tie rod 10, while the threaded portion 38*b* is screwed into the threaded hole 37 in the plate-like body 33. A knurled wheel 39 is fixed coaxially on the shaft 38 between the threaded portions 38*a*, 38*b* and is fixed for rotation therewith.

The support base 21 is provided on opposite sides with identical, parallel, upwardly bent wings 40, 41 which give the base the appearance essentially of a channel.

A plate-like lever 42 is pivoted to these wings 40, 41 and is formed in its part facing the support base 21 with two identical, transverse hook-shaped seats 43, 43 engageable with the hooked end 36 of the plate-like body 33.

It should be noted that the front end 42*a* of the lever 42 is rounded and defines an inclined plane with an inclination substantially equal to that of the hooked end 36 of the plate-like body 33. Finally it should be noted that the distance between the wings 40, 41 of the support base is essentially equal to the width of the hooked end 36 of the plate-like body 33 mentioned above.

Again, in this embodiment of the fastening device of the invention, the screw and nut coupling which connects the hook member 33 to the tie rod 10, and hence to the lever 6 (which as a whole constitute a tightening unit) allows a fine adjustment of the tightness of the fastening to be effected under load, that is to say, when the hook member is operatively engaged in one of the hook-shaped seats in the plate-like lever 42.

In the screw and nut coupling of the first embodiment (FIGS. 1 to 3) of the device of the invention, the nut is freely rotatable relative to the hook member (ring 13), while in the second embodiment it is the screw 38 which is freely rotatable relative to the hook member 33.

I claim:

1. A fastening device for ski boots comprising:

a support base;

a plate-like lever pivotally mounted on said support base;

at least one hook-shaped transverse seat in said lever on a side facing said support base;

a hook-shaped member having a hooked end releasably engageable with said at least one hook-shaped seat;

a plate-like portion end being provided on said hook-shaped member and including a threaded hole being positioned therein;

a tightening unit;

a tie rod having a first end pivoted to said tightening unit and a second end forming an enlarged head;

a threaded hole formed in said enlarged head of said tie rod;

a shaft having a first threaded end portion screwed into the threaded hole of said hook-shaped member and a second threaded end portion screwed into the threaded hole of the enlarged head of said tie rod, said first and second end portions of said shaft being oppositely threaded; and a knurled wheel being affixed substantially half-way along said shaft, imparting rotation to said knurled wheel enables a fine under load adjustment in tightening said plate-like lever relative to said hook-shaped member while said plate-like lever and said hook-shaped member are in engagement.

2. A fastening device according to claim 1, and further including a plurality of parallel hook-shaped transverse seats being positioned in said lever on the side facing said support base.

3. A fastening device according to claim 1, and further including spring means for biasing said plate-like lever toward said support base.

* * * * *